US006206298B1

(12) United States Patent
Ting

(10) Patent No.: US 6,206,298 B1
(45) Date of Patent: Mar. 27, 2001

(54) DC POWERED LOW RESISTANCE WATER PUMP AND A WATERWORKS DISPLAY EMPLOYING SAID PUMP

(75) Inventor: Charles Ting, Taipei (TW)

(73) Assignee: T.L. Products Promoting Co., Ltd., Taipei (TW)

( * ) Notice: Subject to any disclaimer, the term of this patent is extended or adjusted under 35 U.S.C. 154(b) by 0 days.

(21) Appl. No.: 09/002,942

(22) Filed: Jan. 5, 1998

(51) Int. Cl.[7] ..... B05B 17/08
(52) U.S. Cl. ..... 239/20; 417/411; 415/169.1
(58) Field of Search ..... 239/20, 18, 17; 417/360, 411; 415/168.1, 169.1

(56) References Cited

U.S. PATENT DOCUMENTS

| | | | | |
|---|---|---|---|---|
| 3,901,439 | | 8/1975 | Willis | 239/12 |
| 4,021,150 | | 5/1977 | Mabuchi | 417/411 |
| 4,352,149 | * | 9/1982 | Stetler | 239/20 X |
| 5,167,368 | * | 12/1992 | Nash | 239/17 |
| 5,288,018 | * | 2/1994 | Chikazumi | 239/20 |
| 5,326,032 | | 7/1994 | Quillin | 239/20 |
| 5,480,590 | | 1/1996 | Neshat et al. | 261/30 |
| 5,571,409 | | 11/1996 | Scarborough | 210/169 |

* cited by examiner

*Primary Examiner*—Lesley D. Morris
(74) *Attorney, Agent, or Firm*—Cohen, Pontani, Lieberman & Pavane

(57) ABSTRACT

A cascade waterfall or water fountain display with a compact, energy-efficient, low cost DC powered water pump. An electronic controller controls the operation of the water pump and is also used to generate visual and sound effects. The water pump is comprised of a DC motor with a motor shaft, a motor housing in which the motor is mounted, and a gasket used to loosely seal the motor within the motor housing. The gasket has an aperture therein through which the motor's shaft passes. The gasket's aperture is sized so that the shaft of the motor passes therethrough with little, if any contact. An impeller is mounted to the motor's shaft for rotation within a pumping chamber. The pumping chamber has a plurality of holes through which water enters, and an outlet through which water is pumped by the impeller to the top of the waterworks structure. The pumping chamber is loosely fit about the shaft of the motor and allows some water to pass out of the pumping chamber to a pressure-relief chamber. The pressure relief chamber, located between the pumping chamber and the motor, has a water outlet port through which any water that has entered the pressure-relief chamber exits the water pump.

9 Claims, 4 Drawing Sheets

DC POWERED LOW RESISTANCE WATER PUMP AND A WATERWORKS DISPLAY EMPLOYING SAID PUMP

FIELD OF THE INVENTION

The present invention relates to a miniature DC powered water pump and to waterfall or water fountain displays employing such a pump.

BACKGROUND OF THE INVENTION

A waterfall display typically employs a submersible water pump to circulate water from a lower reservoir to an elevated surface from which the water cascades back toward the lower reservoir, thereby creating a simulated waterfall. Examples of such waterfall displays are disclosed in U.S. Pat. Nos. 3,901,439, 5,326,032 and 5,571,409. Such a waterfall display tends to be bulky and heavy because the pump is typically a submersible alternate-current (AC) powered pump that is large and unwieldy and requires a large reservoir for submersion therein. Submersible AC powered pumps are typically bulky and costly to manufacture because, due to their high operating voltage, they must meet stringent electrical shielding and/or insulation requirements to protect users and the pumps in an aqueous operating environment. The associated AC power cord also detracts from the aesthetics of the display as it is difficult to hide and route. Furthermore, the power cord, because of its limited length, restricts where the display may be located. As a result, the display can often not be placed at a desired location.

Accordingly, there is a need for small, low-cost battery or direct-current (DC) powered water pumps which have none of the aforementioned disadvantages. However, such DC powered water pumps must be energy efficient so as not to require users to frequently replace or recharge the batteries powering the motors. One way to increase the efficiency of a water pump is to reduce friction encountered by the rotating shaft of the motor. Because the motor must also be in a water tight chamber, a seal or gasket must be used to isolate the motor from the water. Such a gasket is mounted tightly about the shaft to isolate the motor from the aqueous environment in which the pump operates. The gasket must be dimensioned to apply sufficient sealing force against the motor shaft so as to prevent water from passing between the shaft and the gasket to reach the motor. However, such a tightly fitting gasket is a source of a considerable frictional load on the motor.

U.S. Pat. No. 4,021,150 discloses a battery powered water pump with a fluid flow directing device for directing fluid admitted through an inlet port to flow away from the motor shaft bearing toward the impeller of the pump. The fluid flow directing device consists of a conical section or a propeller mounted onto the motor shaft. However, in this device, all of the water being pumped flows past the motor shaft from the motor housing, thereby increasing the likelihood that water will leak into the motor housing to damage the motor.

SUMMARY OF THE INVENTION

The present invention is directed to a cascade waterfall or water fountain display with a compact, energy-efficient, low cost DC powered water pump. An electronic controller controls the operation of the water pump and is also used to generate visual and sound effects. Multiple water pumps may be used to vary the intensity of the simulated waterfall or to create several distinct water flowing paths.

The waterworks display includes a cascade structure having a top reservoir, and a base reservoir disposed proximate the base for containing water. A water pump is used to pump the water to the top of the cascade waterworks structure from which the water cascades by gravity to the base reservoir.

The water pump is comprised of a DC motor with a motor shaft, a motor housing in which the motor is mounted, and a gasket used to loosely seal the motor within the motor housing. The gasket has an aperture therein through which the motor's shaft passes. The gasket's aperture is sized so that the shaft of the motor passes therethrough with little, if any contact. An impeller is mounted to the motor's shaft for rotation within a pumping chamber. The pumping chamber has a plurality of holes through which water enters, and an outlet through which water is pumped by the impeller to the top of the waterworks structure. The pumping chamber is loosely fit about the shaft of the motor and allows some water to pass out of the pumping chamber around the motor's shaft to a pressure-relief chamber. The pressure relief chamber, which is located between the pumping chamber and the motor, has a water outlet port through which any water that has entered the pressure-relief chamber exits the water pump. As a result, pressurized water is less likely to enter the sealed cavity of motor housing through the aperture of the gasket, and thus the likelihood is reduced that water will come into contact with the motor to damage it. Consequently, the seal between the aperture in the gasket need not tightly fit the shaft of the motor, but may instead be a loose fit, thereby reducing friction and resistance to the operation of the motor. In addition, by not providing a water-tight seal between pumping chamber and the shaft of the motor, friction opposing rotation of the shaft is reduced.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
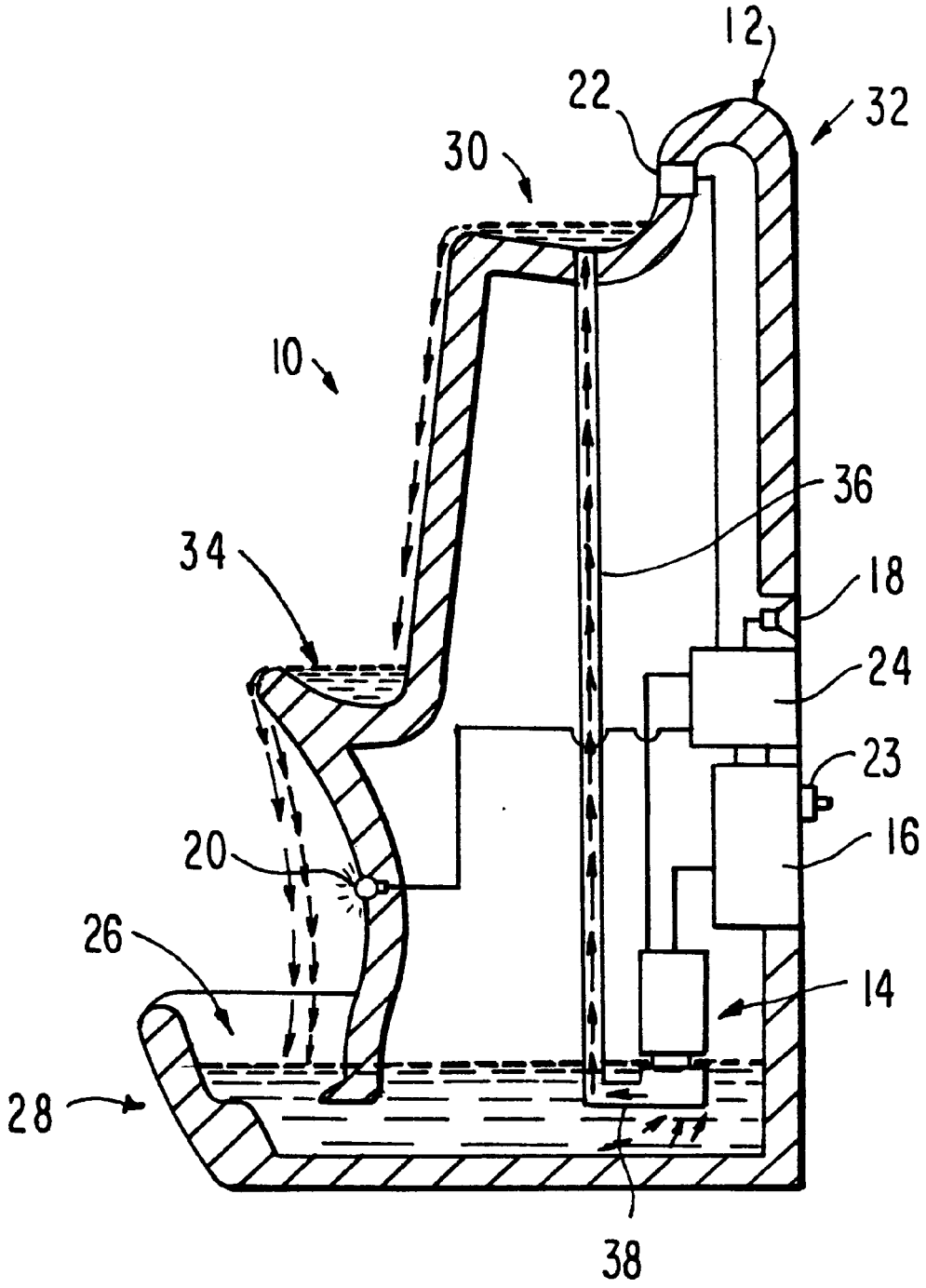
FIG. 1 depicts a cross-sectional view of an embodiment of the waterworks display of the present invention.

FIG. 1 shows a presently preferred embodiment of the waterworks display of the present invention. The waterworks display 10 comprises a cascade structure 12, a compact, energy-efficient water pump assembly 14, a power source 16, a speaker 18, a light 20, a sensor 22, an electronic controller 24, and an on/off switch 23. The cascade structure 12 includes a lower reservoir 26 at its base 28, an upper reservoir 30 at its top 32 and an intermediate reservoir 34 disposed between the upper and lower reservoirs 30, 26 so that water overflowing the upper reservoir 30 can cascade by gravity to the intermediate reservoir 34 and from there into the lower reservoir 26. The display 10 also includes a conduit 36 connecting an outlet 38 of the water pump assembly 14 to the upper reservoir 30 so that water from the lower reservoir 26 can be pumped back up to the upper reservoir 30. The power source 16 is preferably a battery pack so as to eliminate the need for a power cord. The water pump assembly 14 is electrically connected to the power source 16 and to the electronic controller 24. The sensor 22, light 20 and speaker 18 are electrically connected to the electronic controller 24. The electronic controller 24 is comprised of circuitry, including an on/off switch 23, that can activate and/or control operation of the various electronic elements of the waterworks display 10 including the water pump assembly 14, the speaker 18, the light 20 and the sensor 22. Preferably, the electronic controller 24 includes circuitry or electronic components that activate the various electronic components in accordance with a pre-programmed mode of operation. The electronic controller 24 preferably includes components capable of generating electrical signals that can be converted to sound, such as music, by the speaker 18. The electronic controller 24 also preferably includes components capable of activating the light 20, which may be a light bulb, a LED or any other light generating device. Preferably, the light 20 is illuminated in rhythm with the sound or music generated by the speaker 18. The sensor 22 may be a motion detector, a light detector, or any other sensing device.

In operation, when the electronic controller 24 activates the water pump assembly 14, water flows upward through the conduit 36 from the lower reservoir 26 into the upper reservoir 30. The water then cascades from the upper reservoir 30 to the intermediate reservoir 34 and back into the lower reservoir 26, thereby creating a simulated waterfall. The electronic controller 24 activates the light 20 to generate visual effects and the speaker 18 to generate sound effects. The sensor 22 is used to activate the electronic controller 24 which then activates any of the aforementioned devices. Any or all of the light 20, the speaker 18 and the sensor 22 may be eliminated.

Figure 2:
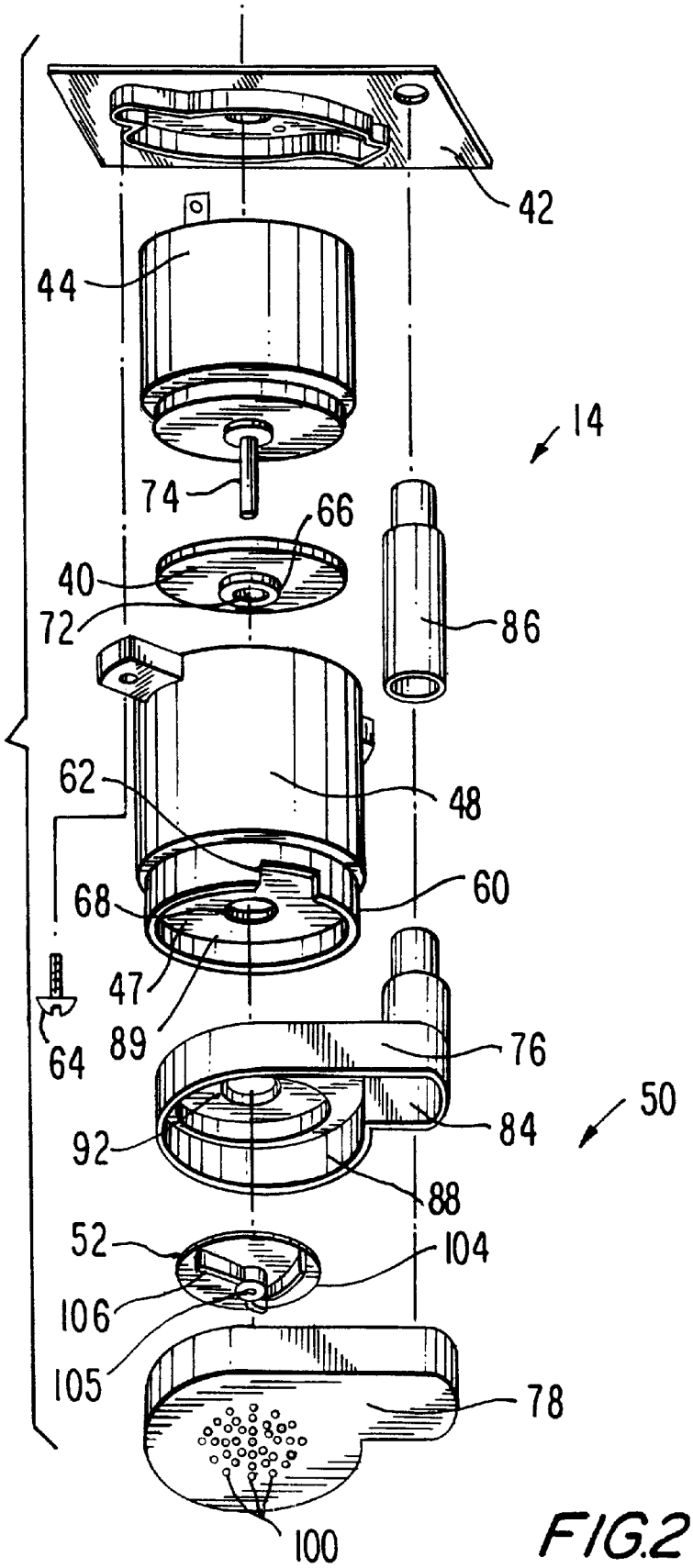
FIG. 2 is an exploded view of the water pump assembly of the embodiment of FIG. 1.
Figure 3:
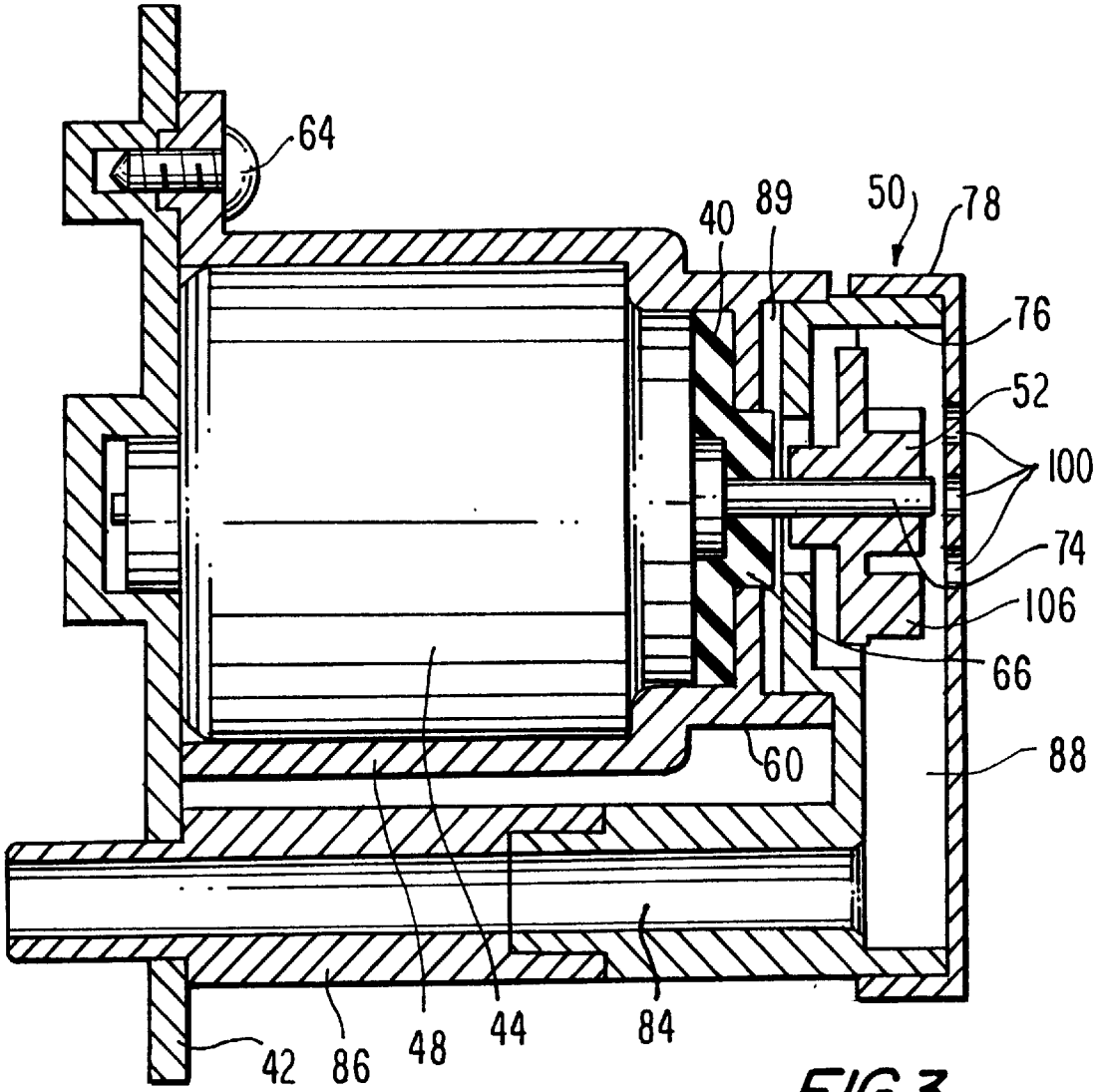
FIG. 3 is a cross-sectional assembled view of the water pump assembly shown in FIG. 2.

FIGS. 2 and 3 show detailed views of an embodiment of the compact, energy-efficient water pump assembly 14 of the present invention. The water pump assembly 14 includes a mounting plate 42, a miniature DC motor 44 with a motor shaft 74, a gasket 40, a motor housing 48, a pump housing 50 and an impeller 52.

The motor housing 48 has an opening sized for receiving the motor 44 and two flanges for mounting the housing 48 to the mounting plate 42. The motor housing 48 preferably includes a skirt 60 circumferentially and axially at one end of the housing 48 to couple, as for example by contact or frictional engagement, with an opposing wall of the pump housing 50 so as to maintain substantial axial alignment of the motor shaft 74 within the pump housing 50 and to space the motor housing 48 from the pump housing 50 at a preselected distance. The skirt 60 preferably has a notch 62 formed therein (as shown in FIG. 2) to allow water to flow therethrough, as discussed below. The motor housing 48 may be secured to the mounting plate 42 by any means, such as screws 64.

Preferably, the gasket 40 is annular and has a raised annular collar 66 projecting axially therefrom. The raised annular collar 66 is sized and configured to seal with opening 68 at the end of the motor housing 48. The raised annular collar 66 is preferably shaped to be substantially flush with the outside surface 47 of the motor housing 48. The gasket 40 has a hole 72 defined centrally in the raised annular collar 66 and dimensioned to receive and substantially or lightly seal with the motor shaft 74 extending therethrough so as to minimize friction at the motor shaft-to-gasket interface. The gasket 40 may be made of rubber or any conventional resilient material used for seals and/or gaskets. Preferably, gasket 40 is formed of a material that has a low coefficient of friction or is coated with such a material.

The pump housing 50 preferably includes an inner pump cover 76 and an outer pump cover 78. The inner and outer pump covers 76, 78 are shaped so that when they are fit together they form an enclosed pumping chamber 88. The inner pump cover 76 has an outlet 84 for discharging water from the pumping chamber 88. Preferably, the outlet 84 extends toward the mounting plate 42. An extender outlet tube 86 may be provided to extend the outlet 84 to and through the mounting plate 42. The inner pump cover 76 has an aperture 92 through which the motor shaft 74 passes. The aperture 92 is advantageously sized to surround but not to seal with the motor shaft 74 extending therethrough so as to eliminate friction at the motor shaft-to-pump housing interface.

The outer pump cover 78 has a water inlet preferably comprised of a plurality of apertures 100 that are preferably dimensioned to prevent sedimentary contaminants collected at the lower reservoir 26 from entering the pumping chamber 88. The inner pump cover 76 is preferably sized and configured to couple with the outer pump cover 78 by, for example, press fitting therewith so as to form the pumping chamber 88. The inner pump cover 76 and the motor housing 48 with its skirt 60 are preferably configured to form a pressure-relief chamber 89. The pressure-relief chamber 89 has an outlet formed by notch 62 through which water can flow.

The impeller 52 is securely mounted to the motor shaft 74 so that it can freely rotate within the pumping chamber 88. The impeller 52 includes a plurality of impeller vanes or blades 106 mounted or formed onto an impeller disk 104. The vanes 106 are shaped to impart centrifugal forces to the water when the impeller 52 is rotated. The entire impeller 52 is preferably molded or otherwise fused as an integral unit. The impeller 52 preferably has an axial aperture 105 dimensioned to frictionally engage with the motor shaft 74. The impeller 52 is sized and configured to fit within the pumping chamber 88 and to minimize water flowing through aperture 92 of inner pump cover 76 when the pump 14 is in operation, i.e., when the impeller 52 rotates. By way of example, the impeller disk 104 is sized to cover the aperture 92.

In operation, the water pump assembly 14 is partially submerged, at least so that the pumping chamber and preferably the pressure-relief chamber 89 is below the surface of the water in the lower reservoir 26. When motor 44 is turned on, impeller 52 is caused to rotate by the motor shaft 74. Water present in the pumping chamber 88 is forcibly driven out by the vanes 106 of the impeller 52 through outlet 84, through outlet tube 86 and into conduit 36. In addition, a small amount of water is driven out of pumping chamber 88 through aperture 92 into pressure-relief chamber 89. However, because the pressure-relief chamber 89 has a water output path, that is notch 62, the pressurized water entering the pressure-relief chamber 89 passes out through notch 62 of the skirt 60 of the motor housing 48, the path of least resistance. As a result, pressurized water is less likely to enter the sealed cavity of motor housing 48 through the hole 72 of gasket 40, and thus the likelihood is reduced that water will come into contact with the motor 44 to damage it. Consequently, the seal between the hole 72 in gasket 40 need not tightly fit the shaft 74 of the motor 44, but may instead be a loose fit, thereby reducing friction and resistance to the operation of the motor. In addition, by not providing a water-tight seal between pumping chamber 88 and the shaft 74 of motor 44, friction to rotation of the shaft 74 is reduced.

Figure 4:
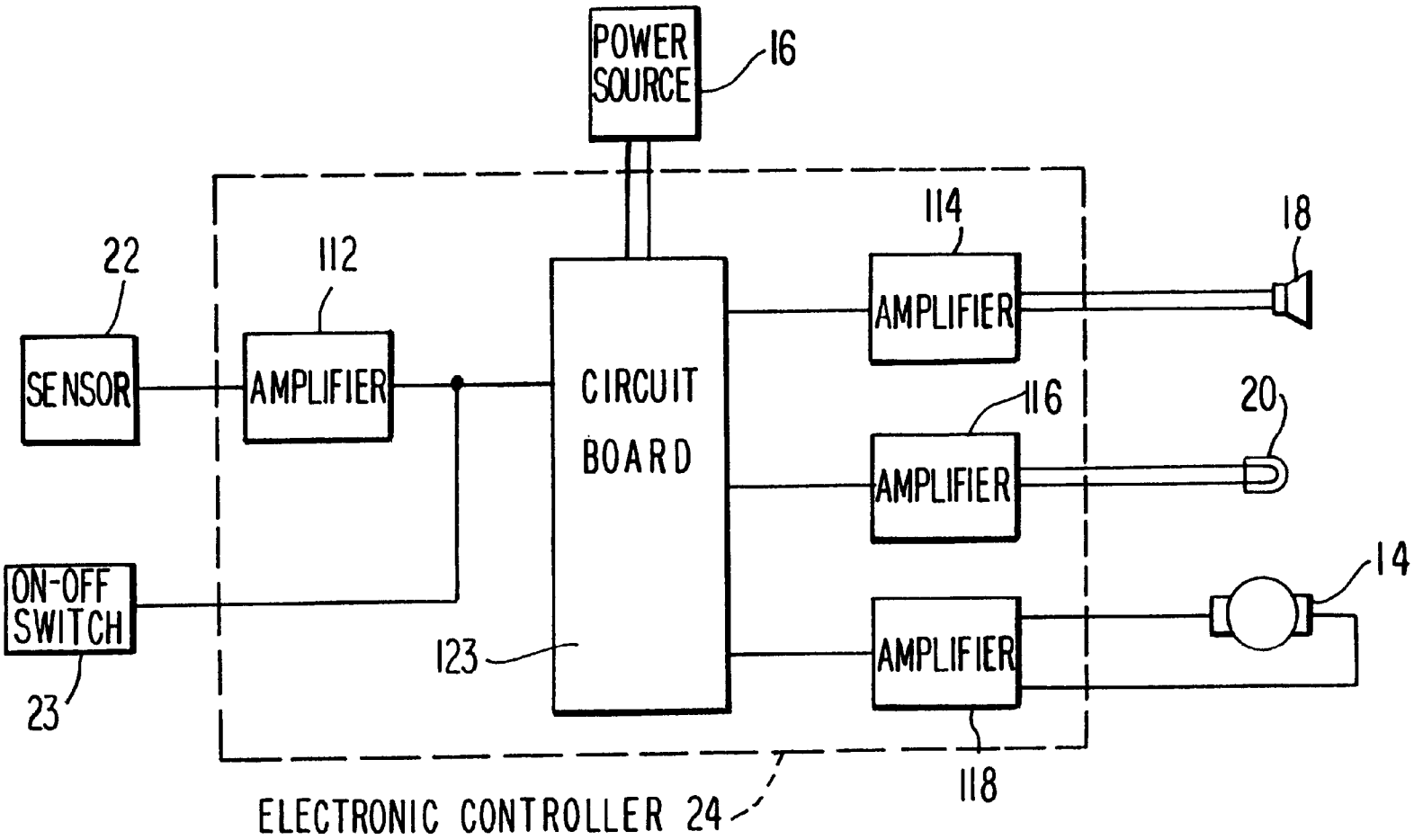
FIG. 4 is a schematic diagram of an embodiment of the electronic circuitry for the waterworks display of FIG. 1.

FIG. 4 is a block diagram of an electronic components of the waterworks display 10 of the present invention. The electronic controller 24 has a circuit board 123 which is electrically connected, at its input end, to a manual on/off switch 23 and to sensor 22 through amplifier 112 . The output of the circuit board 123 is electrically connected through amplifier 114 to the speaker 18, through amplifier 116 to the light 20, and through amplifier 118 to the pump 14. The circuit board 123 preferably includes a means, such as a pre-programmed electronic chip, to store data and electronic instructions/programs for selectively activating the pump 14 and for generating the desired visual and sound effects through speaker 18 and light 20. The circuit board 123 is also electrically connected to the power source 16. To conserve power, the circuit board 123 may include a device (not shown) such as a capacitor circuit or a clock circuit which is used to limit the amount of time that the pump 14, the speaker 18, and/or the light 20 operate.

In operation, a user may activate the electronic control system of the waterworks display 10 by either triggering the sensor 22 and/or by moving the switch 23 to the ON position. The circuit board 123 then sends the appropriate signals to the speaker 18 for generating musical tunes or sounds, to the light 20 for generating the desired light effects, and to the pump 14 for circulating water.

A plurality of water pumps may be included in the waterworks display of the present invention so that a user may selectively adjust, for example, the volume of water cascading down the cascade structure 12. Additionally, there may be more than three water reservoirs, and there may be more than one discrete path that the water flows. Furthermore, one motor can be used to control the water flow along each water path, with each motor being controlled by the same controller 24 or separate individual controllers.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A fluid cascade display, comprising:

a cascade structure having a top reservoir and a base reservoir disposed below the top reservoir, the cascade structure being formed so as to include a fluid overflow path and a fluid supply path, the fluid overflow path connecting the top reservoir to the base reservoir so that fluid overflowing the top reservoir flows along the fluid overflow path into the base reservoir, the fluid supply path connecting the base reservoir to the top reservoir, the top and base reservoirs being capable of containing a fluid;

a fluid pump assembly mounted to the cascade structure and interposed along the fluid supply path and being operable to pump fluid from the base reservoir to the top reservoir, comprising:

a motor housing having a opening defined at one end thereof;

a DC powered motor having a motor shaft, said motor being mounted within said motor housing so that said motor shaft extends through the opening in the motor housing, said motor shaft rotating upon activation of said motor;

a gasket having an opening passing therethrough, the opening being sized so that the motor shaft can pass therethrough, the gasket being mounted to said motor housing and sized so that the opening in said motor housing is sealed by said gasket;

a pump housing mounted to said motor housing and shaped to seal the opening in said motor housing, said pump housing being shaped so as to provide a pressure relief chamber having an outlet therefrom to said base reservoir, said pump housing being shaped so as to define a pumping chamber therein, said pump housing having an opening therein through which the motor shaft passes through the pressure relief chamber into the pumping chamber, said pump housing having a fluid inlet passage through which fluid can enter the pumping chamber from said base reservoir, said pump housing having a fluid outlet passage through which fluid can exit the pumping chamber to flow along the fluid supply path to the top reservoir; and an impeller affixed to an end of the motor shaft, said impeller being shaped and disposed for rotation in the pumping chamber to pump fluid from the pumping chamber into the fluid outlet passage;

a power source; and a means electrically connected to said power source and said motor for controlling operation of said motor.

2. The fluid cascade display of claim 1, further comprising a speaker mounted to said cascade structure and electrically connected to said controlling means, and wherein said controlling means further comprises means for causing said speaker to generate sound.

3. The fluid cascade display of claim 1, further comprising a light mounted to said cascade structure and electrically connected to said controlling means, and wherein said controlling means further comprises means for causing said light to generate light.

4. The fluid cascade display of claim 2, further comprising a light mounted to said cascade structure and electrically connected to said controlling means, and wherein said controlling means further comprises means for causing said light to generate light.

5. The fluid cascade display of claim 1, further comprising a sensor mounted to said cascade structure and electrically connected to said controlling means, said sensor being operable to detect a stimulus and to send a signal to said controlling means in response to detection of the stimulus by said sensor, said controlling means being operable to activate said motor in response to receipt by the controlling means of the signal.

6. The fluid cascade display of claim 2, further comprising a sensor mounted to said cascade structure and electrically connected to said controlling means, said sensor being operable to detect a stimulus and to send a signal to said controlling means in response to detection of the stimulus by said sensor, said controlling means being operable to activate at least one of said motor and said speaker in response to receipt by the controlling means of the signal.

7. The fluid cascade display of claim 3, further comprising a sensor mounted to said cascade structure and electrically connected to said controlling means, said sensor being operable to detect a stimulus and to send a signal to said controlling means in response to detection of the stimulus by said sensor, said controlling means being operable to activate at least one of said motor and said light in response to receipt by the controlling means of the signal.

8. The fluid cascade display of claim 4, further comprising a sensor mounted to said cascade structure and electrically connected to said controlling means, said sensor being operable to detect a stimulus and to send a signal to said controlling means in response to detection of the stimulus by said sensor, said controlling means being operable to activate at least one of said motor, said speaker, and said light in response to receipt by the controlling means of the signal.

9. A fluid pump comprising:

a motor housing having a opening defined at one end thereof;

a DC powered motor having a motor shaft, said motor being mounted within said motor housing so that said motor shaft extends through the opening in the motor housing, said motor shaft rotating upon activation of said motor;

a gasket having an opening passing therethrough, the opening being sized so that the motor shaft can pass therethrough, the gasket being mounted to said motor housing and sized so that the opening in said motor housing is sealed by said gasket;

a pump housing mounted to said motor housing and shaped to seal the opening in said motor housing, said pump housing being shaped so as to provide a pressure relief chamber having an outlet therefrom, said pump housing being shaped so as to define a pumping chamber therein, said pump housing having an opening therein through which the motor shaft passes through the pressure relief chamber into the pumping chamber, said pump housing having a fluid inlet passage through which fluid can enter the pumping chamber, said pump housing having a fluid outlet passage through which fluid can exit the pumping chamber; and an impeller affixed to an end of the motor shaft, said impeller being shaped and disposed for rotation in the pumping chamber to pump fluid from the pumping chamber into the fluid outlet passage.

* * * * *